US009368337B2

(12) United States Patent
Antsiferov et al.

(10) Patent No.: US 9,368,337 B2
(45) Date of Patent: Jun. 14, 2016

(54) LIGHT SOURCE WITH LASER PUMPING AND METHOD FOR GENERATING RADIATION

(71) Applicant: RND-IS-AN, LTD, Troitsk, Moscow (RU)

(72) Inventors: Pavel Stanislavovich Antsiferov, Moscow (RU); Konstantin Nikolaevich Koshelev, Moscow (RU); Vladimir Mikhailovich Krivtsun, Moscow (RU); Aleksandr Andreevich Lash, Moscow (RU)

(73) Assignee: OOO "RnD-ISAN", Troitsk, Moscow (RU)

( * ) Notice: Subject to any disclaimer, the term of this patent is extended or adjusted under 35 U.S.C. 154(b) by 103 days.

(21) Appl. No.: 14/650,657

(22) PCT Filed: Aug. 23, 2013

(86) PCT No.: PCT/RU2013/000740
§ 371 (c)(1),
(2) Date: Jun. 9, 2015

(87) PCT Pub. No.: WO2014/098647
PCT Pub. Date: Jun. 26, 2014

(65) Prior Publication Data

US 2015/0311058 A1 Oct. 29, 2015

(30) Foreign Application Priority Data

Dec. 17, 2012 (RU) ..... 2012154354

(51) Int. Cl.
*H01J 11/00* (2012.01)
*H01J 61/02* (2006.01)
*H01J 63/08* (2006.01)

(52) U.S. Cl.
CPC ..... *H01J 61/025* (2013.01); *H01J 63/08* (2013.01)

(58) Field of Classification Search
None
See application file for complete search history.

(56) References Cited

U.S. PATENT DOCUMENTS

| | | | | |
|---|---|---|---|---|
| 8,242,695 | B2 * | 8/2012 | Sumitomo | H01J 61/025 250/504 R |
| 8,309,943 | B2 * | 11/2012 | Smith | B82Y 10/00 250/365 |
| 2007/0228300 | A1 * | 10/2007 | Smith | B82Y 10/00 250/504 R |
| 2010/0264820 | A1 | 10/2010 | Sumitomo et al. | |
| 2011/0204265 | A1 | 8/2011 | Smith et al. | |

FOREIGN PATENT DOCUMENTS

| | | | |
|---|---|---|---|
| RU | 2210152 | C1 | 10/1998 |

* cited by examiner

*Primary Examiner* — Ashok Patel
(74) *Attorney, Agent, or Firm* — Nadya Reingand

(57) ABSTRACT

The invention relates to light sources with laser pumping and to methods for generating radiation with a high luminance in the ultraviolet (UV) and visible spectral ranges. The technical result of the invention includes extending the functional possibilities of a light source with laser pumping by virtue of increasing the luminance, increasing the coefficient of absorption of the laser radiation by a plasma, and significantly reducing the numerical aperture of a divergent laser beam which is to be occluded and which is passing through the plasma. The device comprises a chamber containing a gas, a laser producing a laser beam, an optical element, a region of radiating plasma produced in the chamber by the focused laser beam, an occluder, which is mounted on the axis of the divergent laser beam on the second side of the chamber, and an optical system for collecting plasma radiation.

18 Claims, 3 Drawing Sheets

LIGHT SOURCE WITH LASER PUMPING AND METHOD FOR GENERATING RADIATION

CROSS-REFERENCE TO RELATED APPLICATIONS

This application is a national stage application of PCT/RU2013/000740 filed on Aug. 23, 2013 which claims priority to Russian application RU2012154354 filed on Dec. 17, 2012 currently issued as a patent RU2539970.

FIELD OF THE INVENTION

The invention relates to laser-pumped light sources and methods for generating a high brightness radiation in ultraviolet (UV) and visible spectral ranges.

PRIOR ART

The plasma of various gases, created by focused beam of a continuous-wave laser at gas pressures of 10-20 atm., is one of the highest-brightness sources of continuous radiation in the wide spectral range of 170-880 nm. As a high-efficient plasma fuel, xenon (Xe), mercury vapors, including mixtures with inert gases, as well as vapors of other metals, and various gas mixtures, including halogenous ones, may be used. Compared to arc lamps, these sources have large lifetimes. The high spectral brightness of laser-pumped light sources, around 10' W/m$^2$/nm/sr at the radiation power level of several watts in conjunction with temporal and spatial stability makes them preferable for many applications. These high-brightness light sources can be used for spectrocheminical analysis, spectral microanalysis of bioobjects in biology and medicine, in microcapillary liquid chromatography, inspection processes for optical lithography. These can also be used for various projection systems, in microscopy, spectrophotometry, and for other purposes. Parameters of the light source, for example, wavelength, power level, and radiation brightness, vary depending on the field of application.

Laser-pumped light sources known, for example, from US patent application 20070228300, published 4 Oct. 2007, IPC H05G2/00, are characterized by high efficiency, reliability, and long service life. However, collection of radiation is carried out primarily in the direction close to normal, relative to the axis of the focused laser beam, which may not be optimal for obtaining radiation of the highest brightness. In addition, within the plasma radiation beam there is a laser radiation present that is not completely absorbed by plasma, which limits the scope of applications of this light source. However, in the solution US20070228300 does not provide measures to suppress laser radiation in the plasma radiation beam.

The specified drawback is absent in the laser-pumped light source, U.S. Pat. No. 8,242,695, published 14 Aug. 2012, IPC H101J 17/20, containing gas chamber, optical element for focusing laser beam, forming in the chamber a region of plasma with high-brightness broadband radiation and providing continuous input of laser power into the plasma; optical system for collecting plasma radiation and blocker for divergent laser beams, passing through the plasma. Optical system for collecting plasma radiation or optical collector is in the form of a concave mirror positioned around the axis of the focused laser beam and has an opening for input of focused laser beam into the plasma and output of plasma radiation.

This light source is characterized by high power and reliable blocking of the divergent laser beam that is not absorbed by the plasma.

However, the blocker, preferably mounted on one of the electrodes for starting plasma ignition, is placed directly in the light source chamber and exposed to large radiating loads. This complicates the design of the chamber and light source as a whole. In addition, the blocker does not allow output of light along the axis of the focused laser beams. As a result, the plasma radiation are directed at the mirror of the optical collector at large angles to the axis of the focused laser beam, which is not optimal for obtaining high-brightness radiation.

Partially devoid of these deficiencies, known from U.S. Pat. No. 8,309,943 published 13.11.12012, IPC H05B31/26, is the laser-pumped light source, comprising a gas-containing chamber, laser, which provides the laser beam; optical element, which focuses laser beam from the first side of the chamber, region of radiating plasma, created in the chamber by the focused laser beam; blocker, mounted on the axis of the divergent laser beam from the second side of the chamber, opposite the first side, and an optical system for collecting plasma radiation.

When employing the method for generating radiation using the specified source, plasma is ignited in the chamber with gas and from the first side of the chamber a laser beam, in continuous mode, is focused into the chamber.

The optical system for collecting plasma radiation consists of a concave mirror, positioned around the axis of the focused laser beam. The mirror has an opening in the first side of the chamber for input of the laser beam into the plasma, and on the second side of the chamber it has an opening for output of plasma radiation. In accordance with the geometry of the light source, output of the plasma radiation onto the optical collector system is performed at large angles to the axis of the focused laser beam. With such geometry, increasing light source brightness requires that plasma radiation brightness be close to the maximum attainable for specified laser power in the direction perpendicular to the axis of the focused laser beam. The region of radiating plasma should preferably have as large as possible or close to 1 aspect ratio d/l transverse d and longitudinal l dimensions of region of radiating plasma. In turn, this requires a sufficiently large numerical aperture $NA_1$ of the focused laser beam.

Hereinafter, the numerical aperture NA of the beam is defined as $NA=n\cdot\sin\theta$, where n—refractive index of the medium, in which the beam propagates, θ—absolute angle between the edge or boundary ray of the beam and its axis. Hereinafter, we can assume that n=1 and $NA=\sin\theta$. In accordance with this, for the numerical aperture NA1 of the focused laser beam, we can fairly infer the relation $NA_1=a/f$, where a—radius of the laser beam at the output from the optical element that is focusing the laser beam, f—focal length of the optical element.

Light source according to U.S. Pat. No. 8,309,943 is characterized by simplicity of the chamber, in the form of a sealed quartz bulb, with high efficiency, reliability, and long service life. Due to the relatively large values of $NA_1$, light source operation is possible with a relatively low power laser.

However, the geometry of the light source, its optical collector, and region of radiating plasma, are not optimal for achieving maximum radiation brightness.

SUMMARY

The object of the invention is optimization of the laser pumping mode, form of the region of radiating plasma, geometry of the optical system for collecting plasma radiation to increase brightness of broadband plasma radiation, as well as improved protection of the optical system for collecting plasma radiation from laser radiation.

The technical result of the invention is the expansion of functional possibilities of the laser-pumped light source due to increased brightness, increase the absorption coefficient of laser irradiation by plasma, significant decrease the numerical aperture of the blocked divergent laser beam passing through the plasma.

Carrying out the stated task is possible with the proposed laser-pumped light source, comprising a chamber, containing gas, a laser, providing a laser beam; an optical element, focusing the laser beam from a first side of the chamber, a region of radiating plasma, created in the chamber using a focused laser beam; a blocker, installed on an axis of a divergent laser beam from a second side of the chamber, opposite the first side, and an optical system for collecting plasma radiation, wherein a numerical aperture $NA_1$ of the focused laser beam and the laser power are selected such that the region of radiating plasma is extended along the axis of the focused laser beam, having a small, ranging from 0.1 to 0.5, aspect ratio d/l of transverse d and longitudinal I dimensions of the region of radiating plasma, brightness of plasma radiation in the direction along the axis of the focused laser beam close to the maximum attainable for a given laser power, a numerical aperture $NA_2$ of the divergent laser beam from the second side of the chamber is less than the numerical aperture $NA_1$ of the focused laser beam from the first side of the chamber: $NA_2<NA_1$, wherein the optical system for collecting plasma radiation is positioned on the second side of the chamber, and an output of plasma radiation onto the optical system for collecting plasma radiation is carried out by a divergent beam of plasma radiation with apex in the region of radiating plasma, characterized by numerical aperture NA and an optical axis, the direction of which primarily coincides with a direction of the axis of the focused laser beam.

In particular, the numerical aperture NA of the divergent plasma radiation beam close in magnitude or greater than a value of aspect ratio d/l of dimensions of the region of radiating plasma: $NA \approx d/l$, or $NA > d/l$.

In particular, the blocker is located in a small axial zone of the divergent laser beam with numerical aperture $NA_2$: $NA_2 \ll NA$.

In particular, the blocker is made reflective, in particular, selectively reflecting the divergent laser beam.

In particular, the blocker is made to absorb the laser beam.

In particular, the blocker is installed at a distance from the chamber and radiation power density of divergent laser beam from the second side of the chamber is less than a damage threshold of the blocker.

In particular, the optical system for collecting plasma radiation is located on the axis of the focused laser beam.

In particular, the optical system for collecting plasma radiation contains an input lens.

In particular, the optical system for collecting plasma radiation contains an input lens and the blocker is implemented as a reflective, in particular selectively reflecting the laser beam, coating on at least part of the input lens surface.

In particular, the blocker is included in the system of optical elements, directing the laser beam from the second side of the chamber back into the region of radiating plasma.

In particular, the optical system for collecting plasma radiation contains an input lens and the blocker is installed at a greater distance from the chamber than the input lens and implemented as plate coating, reflecting the divergent laser beam.

In particular, the blocker is implemented as an optical element, directing the divergent laser beam that passed through the plasma back into the region of radiating plasma.

In particular, the region of radiating plasma has an aspect ratio d/l of transverse and longitudinal dimensions in range of 0.14 to 0.4.

In particular, a concave modified spherical minor with center in the region of the radiating plasma is located on the first side of the chamber, having an opening, in particular, optical opening, for input of focused laser beam in the region of radiating plasma.

Another invention from this group of inventions relates to a method of generating radiation, wherein the plasma is ignited in a chamber with gas and from a first side of the chamber a laser beam, in continuous mode, is focused into the chamber, a region of radiating plasma is formed along an axis of focused laser beam, with a small, ranging from 0.1 to 0.5, aspect ratio d/l of its dimensions, wherein brightness of plasma radiation in a direction along the axis of the focused laser beam is close to a maximum attainable for a specified laser power, with properties of plasma lens, providing a decrease in a numerical aperture $NA_2$ of a divergent laser beam from a second side of the chamber compared to a numerical aperture $NA_1$ of the focused laser beam from the first side of the chamber: $NA_2<NA_1$; an output plasma radiation onto an optical system, located on the second side of the chamber, for collecting plasma radiation is carried out using a divergent beam of plasma radiation, with a direction of an optical axis primarily coinciding with the direction of the axis of the focused laser beam, and by using the blocker prevent the passage of the divergent laser beam to the optical system for collecting plasma radiation.

In particular, the laser beam that passed through the region of radiating plasma is directed back to the region of radiating plasma due to its reflection from the blocker.

In particular, focused laser beam is inputted into the region of radiating plasma through an opening, in particular, the optical opening installed on the first side of a chamber concave spherical mirror or a concave modified spherical mirror with a center in the region of radiating plasma and the divergent beam of plasma radiation, directed onto the optical system for plasma radiation collection, is enhanced by a plasma radiation beam, reflected from the concave spherical mirror or the concave modified spherical mirror.

These objects, features, and advantages of the invention, as well as the invention itself will be more clearly understandable in the following description of invention embodiments, illustrating in the accompanying figures.

BRIEF DESCRIPTION OF THE DRAWINGS

The technical essence and operating principle of the proposed device is illustrated by figures, in which.

In the figures, identical device elements have the same reference numbers.

EMBODIMENTS OF THE INVENTION

This description is intended to illustrate the invention embodiments and not the entire scope of the present invention.

Figure 1:
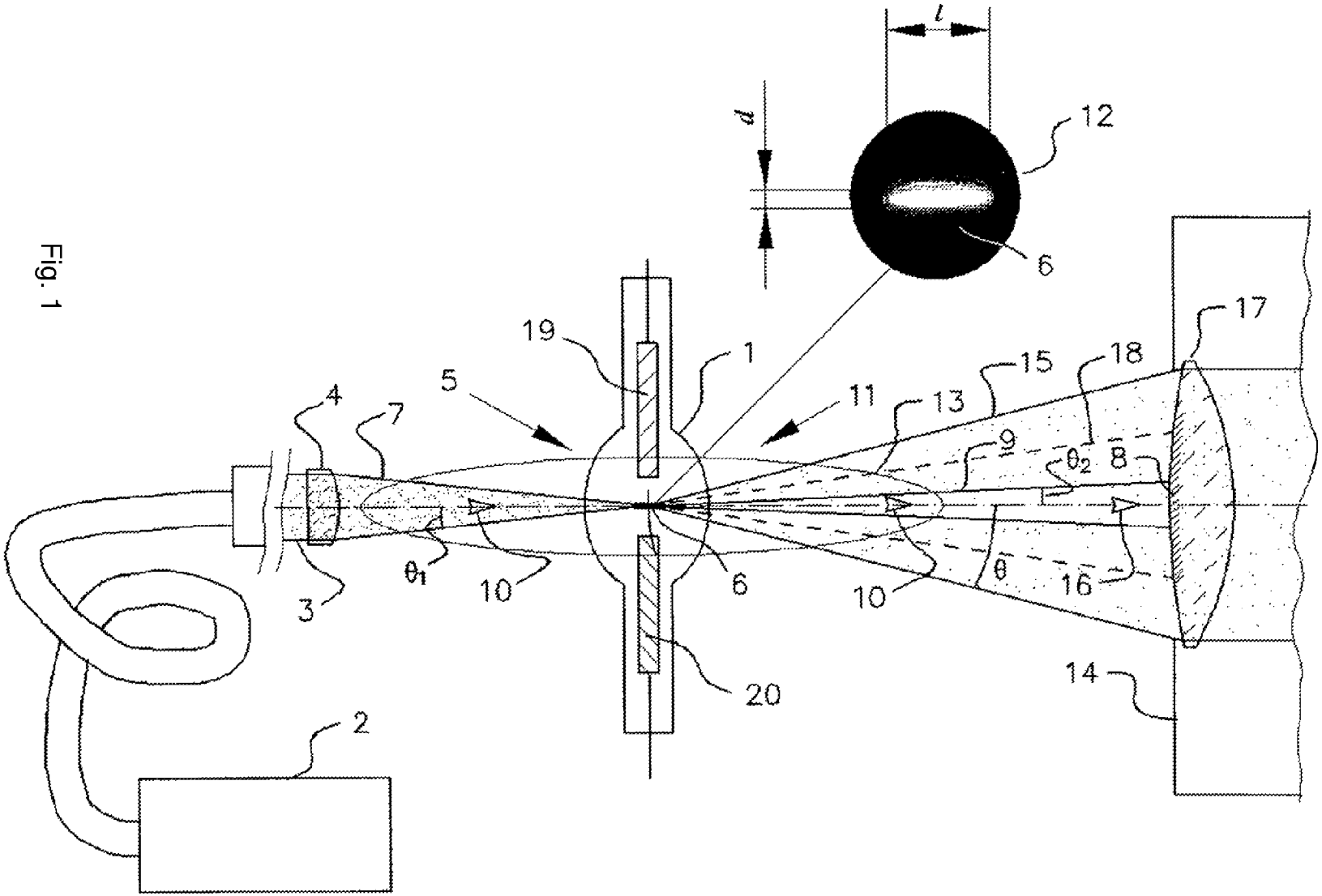
FIG. 1 shows a schematic representation of the light source, as well an enlarged photographic image of the region of radiating plasma.

In accordance with an example of the invention embodiment, laser-pumped light source includes a chamber 1, containing gas, in particular, high pressure xenon at 10-20 atmospheres; laser 2, providing the laser beam 3; optical element 4, focusing the laser beam from the first side 5 of the chamber 1, region of radiating plasma 6, created in chamber 1 by the focused laser beam 7; blocker 8, mounted on the axis 10 of the divergent laser beam 9 from the second side 11 of chamber 1, opposite the first side 5, (FIG. 1).

Wherein the numerical aperture $NA_1$===sin $\theta_1$ for the focused laser beam 7 and power of the laser 2, are chosen such that

- region of radiating plasma 6 is extended along the axis 10 of the focused laser beam 7, having a small, in the range of 0.1 to 0.5, aspect ratio d/l transverse d and longitudinal l dimensions of the region of radiating plasma 6,
- plasma radiation brightness in the direction along the axis of the focused laser beam is close to the maximum attainable for the specified laser 2 power,
- numerical aperture $NA_2$ of the divergent laser beam 9 passing through the region of radiating plasma from the second side 11 of the chamber 1 is less than the numerical aperture $NA_1$ of the focused laser beam 7 from the first side 5 of the chamber: $NA_2<NA_1$ (FIG. 1).

Herein $\theta_1$—angle between the boundary rays of the focused laser beam 7 and its axis 10, $NA_2$: sin $\theta_2$, $\theta_2$—angle between the boundary ray of the divergent laser beam 9 that passed through the region of radiating plasma and its axis 10.

Enlarged photograph 12 (FIG. 1) illustrates a region of radiating plasma 6 extended along the axis of the focused laser beam with small aspect ratio d/l=0.33 mm/0.19 mm=0.17, achieved when implementing the light source according to current invention at laser power of 100 W at wavelength of 1.07 microns, numerical aperture of the focused laser beam $NA_1$=0.12 and Xenon at a pressure of 20 atm in the chamber. The sector of brightness 13 (FIG. 1) illustrates an angular, in particular, relative to the axis 10 of the focused laser beam, distribution of plasma radiation brightness. Created on the basis of measurements (for emission wavelength of 550 nm), the sector of brightness 13 shows that when making the laser-pumped light source in accordance with the invention the brightness of plasma radiation in the direction along the axis 10 of the focused laser beam significantly, in this case approximately by 6 times, exceeds the brightness of radiation in the direction transverse to the axis 10 of the focused laser beam.

Brightness of light source image, according to the principle of the invariance of brightness, is transferred by the optical system in the absence of losses and without changes. Therefore, in accordance with the invention, in order to ensure the greatest light source brightness, the optical system 14 for collecting plasma radiation is located on the second side 11 of the chamber 1 such that the exit of plasma radiation onto the optical system 14 for collecting plasma radiation is carried out by the divergent laser beam 15 of plasma radiation with apex in the region of radiating plasma 6. Directed to the optical system 14 for collecting plasma radiation, the divergent laser beam 15 of plasma radiation is characterized by numerical aperture NA=sin $\theta$ and optical axis 16, the direction of which primarily coincides with the direction of the axis 10 of the focused laser beam 7. Herein $\theta$—angle between the boundary ray of the divergent beam 15 of plasma radiation and its axis 16, (FIG. 1).

Figure 2:
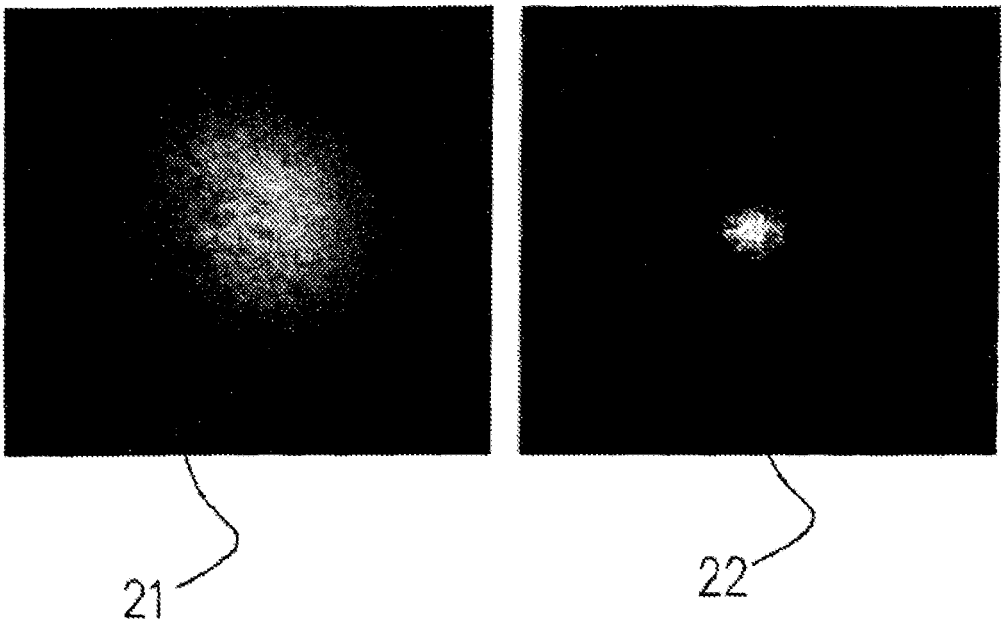
FIG. 2 shows the imprint of the divergent laser beam after passing through the chamber without plasma ignition in it and with plasma for the light source, implemented in accordance with the invention.

FIG. 2 illustrates the refraction effect leading to the self-focusing of the divergent laser beam passing through the plasma. The effect is achieved by selecting the numerical aperture $NA_1$ of the focused laser beam and laser power in accordance with the present invention. FIG. 2, for the case of $NA_1$=0.12 and $P_1$=80 W, where $P_1$ is the level of laser radiation power in the focused laser beam 7 from the first side 5 of chamber 1, shows the imprint of divergent laser beam that passed through the plasma on the screen mounted on the second side 11 of chamber 1 for the cases where plasma does not ignite in the chamber—photograph 21 and for the presence of plasma in the chamber—photograph 22. Ultraviolet filter is installed to cut off visible plasma radiation on the path to the divergent laser beam during recording. In the case of absence of plasma in the chamber, illustrated by photograph 21, the numerical aperture $NA_2$ of the divergent laser beam 9 from the second side 11 of the chamber is equal to the absolute quantity of numerical aperture $NA_1$ of the focused laser beam 7 from the first side 5 of the chamber. In the presence of plasma, as seen on photograph 22 (FIG. 2), the imprint and, correspondingly, the numerical aperture $NA_2$ of the divergent laser beam 9 that passed through the plasma from the second side 11 of the chamber are significantly reduced: $NA_2 \ll NA_1$. The observed effect that accompanies optimal device operation is realized, primarily, due to the non-homogenous radial profile of the plasma-refraction index, that is, as a result of forming a plasma lens in the region of radiating plasma 6 and refraction of the laser beam on the plasma lens. In conjunction with this and in accordance with the invention, the numerical aperture $NA_2$ of the divergent laser beam 9 that passed through the plasma from the second side 11 of the chamber 1 is significantly smaller than the numerical aperture NA, of the focused laser beam 7 from the first side 5 of the chamber: $NA_2<NA_1$.

Formation of the plasma lens in the region of radiating plasma 6 and significant reduction of numerical aperture $NA_2$ of the divergent laser beam 9 that passed through the plasma, blocked from the second side 11 of chamber 1, allows at $NA_2 \ll NA$ the use of simple and reliable non-selective blockers for the small axial zone of the plasma radiation beam 15, either reflecting the radiation in broadband spectral range, or completely absorbing them. This simplifies the light source design, ensuring reliability, high stability, and long service life. In conjunction with this and in accordance with the invention, the blocker 8 is located in the small axial zone of the divergent laser beam 9 that passed through the plasma with numerical aperture $NA_2$: $NA_2 \ll NA$ (FIG. 1).

In the invention embodiment, the size of the numerical aperture NA of the divergent plasma radiation beam, by which the output of plasma radiation on the optical system 14 for collecting plasma radiation is carried out, is roughly equal to the size or greater than the aspect ratio d/l of transverse and longitudinal dimensions of the region of radiating plasma: NA≈d/l, or NA>d/l. On FIG. 1 the boundaries of the divergent beam 18 with numerical aperture NA=d/l, directed along the axis 10 of the focused laser beam 10, shown with dashed lines. For the region of radiating plasma 6, characterized by small aspect ratio d/l and having a high degree of optical transparency for intrinsic emission, the radiation brightness across the beam 15 in the range of specified numerical apertures NA=d/l, as illustrated in the brightness diagram 16, changes insignificantly: no more than 25%. In conjunction, when the numerical aperture of the divergent plasma radiation beam NA≈d/l, or NA>d/l, high collection efficiency in the direction of greatest plasma radiation brightness is ensured.

In the preferred embodiment of the invention, the optical system 14 for collecting plasma radiation is located on the second side 11 of chamber 1 one the axis 10 of the focused laser beam 7. Unlike its analogs, which use an optical system for collecting plasma radiation that is primarily located off-axis from the focused laser beam, this provides simplicity of laser-pumped light source.

By arranging the optical system for collecting plasma radiation on the axis of the focused laser beam, in particular, coaxially with the laser beam, symmetrical distribution of plasma radiation brightness along the plasma radiation beam aperture is achieved.

In the preferred embodiment of the invention, the optical system 14 for collecting plasma radiation contains an input lens 17. Wherein, blocker 8 can be made of reflective, in particular, selectively reflective of laser beam, coating on at least part of the input lens 17 surface (FIG. 1). This ensures simplicity and efficiency of the optical system for collecting plasma radiation. Input or front lens 17 can be a part of the lens assembly. Wherein, it is preferable to use an input lens or lens with minimal aberrations, in particular, chromatic ones.

In the preferred embodiment of the invention, the region of radiating plasma has an aspect ratio d/l for transverse and longitudinal dimensions in the range of 0.14 to 0.4. As shown experimentally, with this aspect ratio of dimensions of the region of radiating plasma, conditions for more efficient device operation are attained in accordance with the present invention when using chamber, containing Xenon at a pressure of 20 atm.

In the invention embodiment chamber 1 contains two electrodes 19, 20 for starting plasma ignition in the discharge gap between them (FIG. 1). There use, as described in detail, in D. A. Cremers, F. L. Archuleta, R. J. Martinez. "Evaluation of the Continuous Optical Discharge for Spectrochemical Analysis". Spectrochimica Acta, V. 4B; No 4, pp. 665-679 (1985) facilitates ignition of plasma, sustained thereafter in continuous mode using a laser. In certain cases, the power density of laser radiation in the chamber is insufficient for plasma ignition, therefore use of electrodes 19, 20 for starting plasma ignition is a necessary condition for creating a region of radiating plasma.

Other embodiments of the invention are directed toward further increasing brightness and efficiency of the laser-pumped light source. In the embodiment, illustrated in FIG. 3, the optical system 14 for collecting plasma radiation contain an input lens 17, wherein blocker 8, is installed at a greater distant from the chamber 1 than the input lens 17 and is in the form of plate 23 reflective coating 8, in particular, selectively reflective of laser beam 9. When the blocker 8 is adjusted accordingly, the system of optical elements 16, 8, 23 (FIG. 3) ensures that the divergent laser beam 9 is directed back to the plasma 6. In accordance with this, the blocker in the invention embodiment is included in the system of optical elements, directing the laser beam that passed through the region of radiating plasma back to the region of radiating plasma. This increases laser pump power, which increases efficiency and light source brightness, expands its range of high-performance operating conditions.

In the invention embodiment, the blocker is made in the form of an optical element, directing the laser beam that passed through the plasma back to the region of radiating plasma. In accordance with this invention embodiment, the blocker can be made in the form of an optical meniscus, installed between chamber 1 and optical system 14 for collecting plasma radiation (not shown). Wherein the meniscus has a surface, spherical or modified spherical with center in the region of radiating plasma 6, facing towards the chamber, and a coating, selectively reflective of laser radiation. As described in detail in U.S. Pat. No. 8,309,943, use of a modified spherical surface can be preferable for compensation for the distortion of motion of optical rays by chamber walls. In this embodiment, laser pump power is also increased, efficiency and light source brightness are increased, and the range of high-performance operating conditions is expanded.

Figure 3:
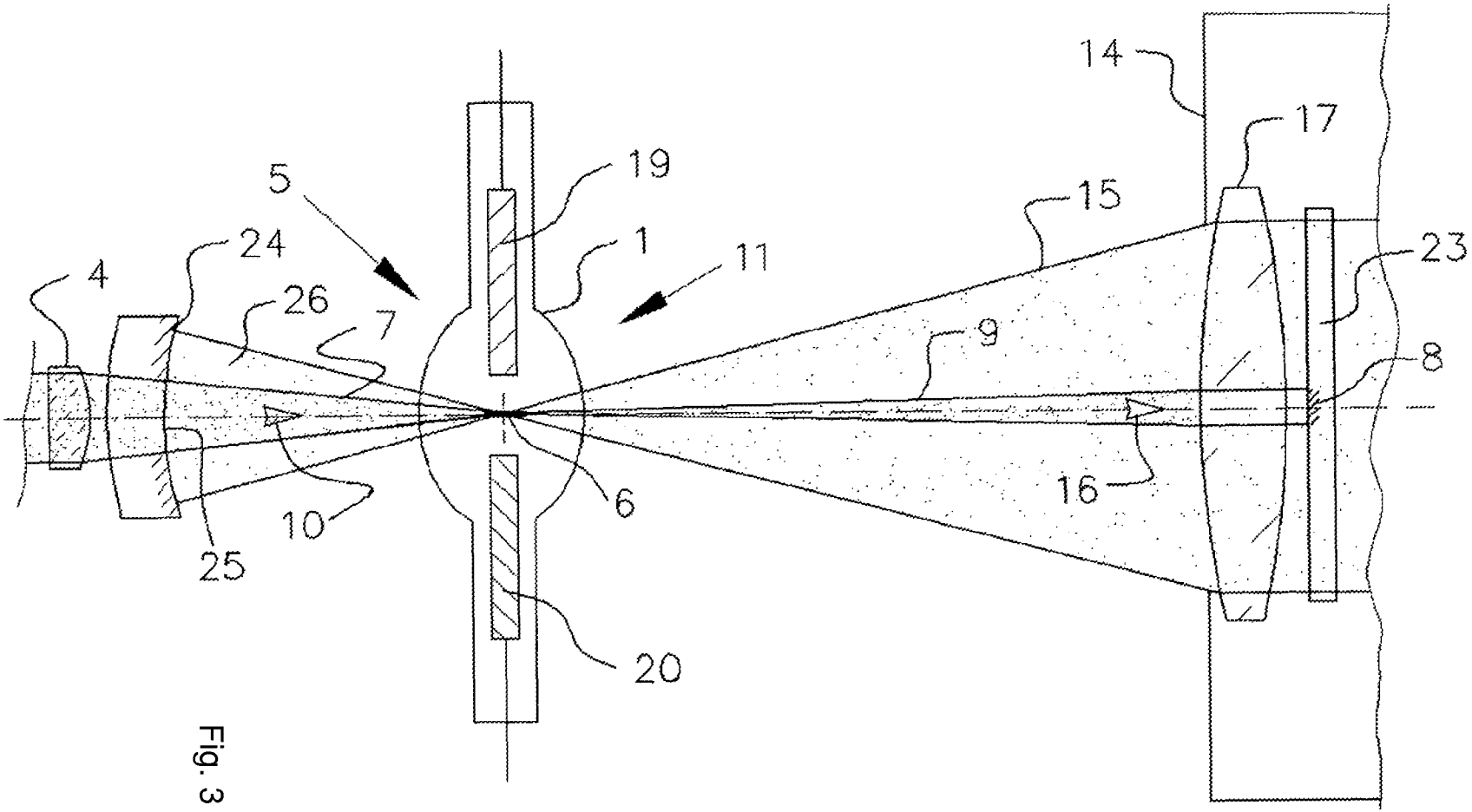
FIG. 3—schematic representation of the light source with blocker, made in the form of a plate coating, selectively reflecting laser radiation, and with additional concave mirror according to invention embodiment.

In the invention embodiment, illustrated in FIG. 3, from the first side 5 of chamber 1 a spherical mirror 24 with center in the region of radiating plasma 6 is installed, having opening 25 for input of focused laser beam 7 into the region of radiating plasma 6. In this invention embodiment, plasma radiation beam 15 is enhanced by plasma radiation beam 26, reflected from the spherical mirror 24 with center in the region of radiating plasma 6, installed on the first side 5 of chamber 1. This allows increasing the brightness on plasma radiation beam 15, significantly increase collection efficiency of plasma radiation and increase light source efficiency as a whole. According to the experiment, the increase in brightness and collection efficiency is about 70%.

In the invention embodiment, the concave spherical mirror 24 is transparent for the focused laser beam 7 near its axis 10, in this embodiment, the concave spherical mirror 24 has an optical opening 25. This embodiment simplifies the design of the concave spherical mirror 24.

In the invention embodiment, a concave modified spherical mirror 24 with center in the region of radiating plasma 6, having opening 25, in particular, optical opening, for input of focused laser beam 7 into the region of radiating plasma 6, is installed on the first side of the chamber. As described in detail in U.S. Pat. No. 8,309,943, use of modified spherical mirror 24 is preferable for compensation for the distortion of motion of optical rays by chamber 1 walls, which increases the efficiency of the laser-pumped light source.

Method for generating radiation, primarily broadband high-brightness radiation using a laser-pumped light source, illustrated in FIG. 1, is implemented as follows. Turn on laser 2, providing a laser beam 3. ignite plasma in chamber 1, containing gas, in particular, Xenon at high, 10-20 atm pressures. Optical element 4, in particular, in the form of focusing lens, from the first side 5 of chamber 1 focuses laser beam 7 into chamber 1. Using the focused laser beam 7 in chamber 1, a region of radiating plasma 6 is created and provides a continuous input of laser power into the region of radiating plasma to maintain generation of high-brightness radiation. By selecting the laser 2 power and numerical aperture $NA_1$ of the focused laser beam 7 in chamber 1, an extended region of radiating plasma 6 is formed along the axis 10 of the focused laser beam, characterized by

- small aspect ratio d/l of transverse d and longitudinal I dimensions, in the range of 0.1 to 0.5, as illustrated in photograph 15,
- brightness of plasma radiation along the axis 10 of the focused laser beam that is close to the maximum attainable for the given laser 2 power,
- properties of the plasma lens, providing a reduction in numerical aperture $NA_2$ of the divergent laser beam from the second side of the chamber that passed through the plasma when compared to numerical aperture NA of the focused laser beam from the first side of the chamber: $NA_2<NA_1$.

Wherein, the output of plasma radiation to the optical system 14 for collecting plasma radiation is performed by the divergent plasma radiation beam 15, whose optical axis 10 direction coincides with the direction of the axis 10 of the focused laser beam 7. Using blocker 8 prevents the laser beam 9 that passed through the plasma from passing through the optical system 14 for collecting plasma radiation, characterized by brightness sector 13.

In the invention embodiment, the laser beam 9 that passed through the region of radiating plasma 6 is directed back to the region of radiating plasma 6 due to its reflection from blocker 8 (FIG. 3).

In other invention embodiments, the laser beam 7 is inputted to the region of radiating plasma 6 through opening 25, in particular, optical opening of the spherical mirror 24, with center in the region of radiating plasma, installed on the first side of the chamber and enhance the divergent plasma radiation beam 15, directed towards the optical system 14 for collecting plasma radiation by the plasma radiation beam 26, reflected from the spherical mirror 24.

In the invention embodiment, the laser beam 7 is inputted into the region of radiating plasma 6 through opening 26, in particular, optical opening of the spherical mirror 24 installed on the first side of the chamber, which compensates for distortions introduced into the path of rays by chamber 1 walls, and enhance the divergent plasma radiation beam 15, directed onto the optical system 14 for collecting plasma radiation by the plasma radiation beam 26, reflected from the modified spherical mirror 24.

The embodiments of the method for generating radiation provides increased brightness of plasma radiation beam 15, increased plasma radiation collection efficiency, and increased light source efficiency as a whole. According to this experiment, increases are around 70%.

During device operation, the value of laser power is chosen between lower and upper boundaries for the existence of a continuous optical discharge, described in detail, for example, in Raizer Yu P "Optical discharges" Sov. Phys. Usp. 23 789-806 (1980). Adjustment of laser 2 power is carried out using laser control system. For a given laser power level, the choosing of numerical aperture $NA_1$=a/f of the focused laser beam 7, providing the maximum plasma radiation brightness in the direction along the axis 10 of the focused laser beam 7, is performed by varying the radius a of laser beam 3, and/or varying the focal length f of optical element 4, which focuses the laser beam, which is usually more convenient. Additional criteria for choosing laser power are forming a region of radiating plasma with the properties of a plasma lens, decreasing the numerical aperture $NA_2$ of the divergent laser beam, from the second side of the chamber, which passed through the plasma, as well as providing high efficiency for the laser-pumped light source as a whole.

It is preferable that the collection of radiation from the region of radiating plasma 7 is carried out by optical system 14, containing input lens 17. In the invention embodiment, prevention of the passage of the divergent laser beam 9 onto the optical system 14 for collecting plasma radiation using blocker 8, implemented as a coating, at least, on part of the surface of the input lens 17, selectively reflecting the laser beam 9 (FIG. 1).

When implementing laser-pumped light source in the proposed form, it acquires substantial new positive qualities.

Realization of the region of radiating plasma 6, extended along the axis of focused laser beam 7, with small aspect ratio, ranging from 0.1 to 0.5, d/l of the transverse and longitudinal dimensions increases efficiency of laser power transmission to the region of radiating plasma 6 and increase the power of the laser-pumped light source.

When the size of the aspect ratio d/l of dimensions of the region of radiating plasma is in the range 0.14 to 0.4, according to experimental data, the highest device operating efficiency is achieved.

For the region of radiating plasma, mostly optically transparent to intrinsic radiation, the greatest brightness with small aspect ratio d/l of dimensions of the region of radiating radiation is achieved in the direction of the axis of the focused laser beam, as illustrated by brightness sector 13 (FIG. 1). As a result, due to the proposed formation of region of radiating plasma 7 with small aspect ratio d/l and the use, for collecting plasma radiation, of plasma radiation beam 15 with optical axis 16, wherein the direction coincides with the direction of the axis 10 of the focused laser beam, maximum brightness of the source of broadband radiation is attained, invariably (excluding losses) transferred by the optical system 14 for collecting plasma radiation.

During light source operation, implemented in accordance with the present invention, $NA_2<NA_1$—due to the implementation of conditions for forming plasma lens in the region of radiating plasma 6, which is accompanied by an increase in fraction of laser radiation absorbed by the plasma, and, therefore, increase light source efficiency, leading to further increased source brightness in the direction of the output of plasma radiation onto the optical system 14 for collecting radiation.

All this determines if you obtain significantly greater brightness from the laser-pumped light source, implemented according to the present invention, as compared to the known analogs, which use off-axis radiation collection.

Additionally, the significant reduction in numerical aperture $NA_2$ of the divergent laser beam that passes through the plasma, in particular, to values much lower than numerical aperture NA of the plasma radiation beam, directed onto an optical system for collecting plasma radiation: $NA_2 \ll NA$, —simplifies blocking of laser radiation and enhances its reliability.

On FIG. 1, the divergent plasma radiation beam with numerical aperture NA=d/I is denoted with dashed lines 18 (FIG. 1). When the value of NA numerical aperture of the divergent beam 15, satisfying the condition NA≈d/l, or NA>d/l, high collection efficiency in the direction of greatest plasma radiation brightness is ensured.

Placement of the optical system for collecting plasma radiation 12 from the second side 5 of chamber 1 provides simplicity of light source with axial plasma radiation collection.

Optical system 14 for collecting plasma radiation can contain reflective, as well as refractive optics or various combinations thereof. Implementing the optical system with input lens 17 (FIG. 1) in accordance with one of the successfully tested invention embodiments simplifies the design of the laser-pumped light source.

Implementing the blocker 8 in the form of a coating, reflective of laser light, on the input lens 16 ensures the source is compact and further simplifies its design. It is preferable for the coating to selectively reflect only laser radiation, transmitting plasma radiation in the broadband spectral range from 170 to 880 nm. This ensures reliable, high-efficiency elimination of unwanted laser radiation from the collection system for plasma radiation.

Implementing the blocker 8 in the form of a coating, reflective of laser light, on the input lens 16 ensures the source is compact and further simplifies its design. It is preferable for the coating to selectively reflect only laser radiation, transmitting plasma radiation in the broadband spectral range from 170 to 880 nm. This ensures reliable, high-efficiency elimination of unwanted laser radiation from the collection system for plasma radiation.

It is preferable, in embodiments of the inventions, to use input lens or lens with minimal aberrations, in particular, with minimal chromatic aberrations.

Here are some examples of light sources according to the invention embodiment, illustrated in FIG. 1. Plasma was produced in the lamp "OSRAM" XBO 150 W/4, filled with Xe at pressure of 20 atm. For laser pumping, ytterbium laser YLPM-1-A4-20-20 IPG IRE-Polus with radiation wavelength $\lambda$=1070 nm and beam radius a=3 mm was used. The power density of laser radiation was insufficient for plasma ignition, therefore two electrodes 19, 20 were used to start plasma ignition.

The experimentally obtained light source characteristics at various laser power levels and with various numerical apertures of focused laser beam $NA_1$, close to optimal, are shown in Table 1. In Table 1, the absorption coefficient K shows the fraction of laser radiation power absorbed by the plasma:

$$K=(P_1-P_2)/P_1,$$

Where $P_1$ and $P_2$ are laser radiation beam power corresponding to the first and second sides of chamber 1.

High-efficiency mode of operation of the laser-pumped light source is achieved at laser radiation power Pt in the range of 70 W to 120 W, with the upper boundary determined by the maximum power of the laser in use, at a numerical aperture $NA_1$ of the focused laser beam in the range of 0.09 to 0.25, with aspect ratio d/l in the range of 0.14 to 0.4.

TABLE 1

Characteristics of embodiments of laser-pumped light source.

| No | $P_1$, W | $NA_1$ | $NA_2$ | Absorption coefficient K | d/l (mm/mm) | Spectral Brightness $10^4 \cdot W/(m^2 \cdot sr \cdot nm)$ |
|---|---|---|---|---|---|---|
| 1. | 110 | 0.2 | 0.14 | 0.8 | 0.38/1.0 = 0.38 | 8.6 |
| 2. | 110 | 0.12 | 0.04 | 0.8 | 0.4/1.9 = 0.21 | 9.1 |
| 3. | 110 | 0.09 | 0.03 | 0.66 | 0.3/2.0 = 0.15 | 11.8 |
| 4. | 70 | 0.12 | 0.065 | 0.6 | 0.3/1.6 = 0.19 | 9.0 |
| 5. | 37 | 0.09 | 0.05 | 0.5 | 0.17/0.75 = 0.23 | 7.4 |

As noted above, the preferred NA numerical aperture value of plasma 7 radiation beam 15 should be approximately equal to or greater than the aspect ratio of the dimensions of the region of radiating plasma: NA≥d/l. For light source with parameters, presented in Table 1, for high-efficiency collection of plasma radiation it is preferable to have a numerical aperture value for the plasma radiation beam, entering the optical system for collecting radiation, in the range from NA >0.2 to NA>0.4.

During operation of light source, implemented in accordance with the present invention, the numerical aperture $NA_1$ of the focused laser beam from the first side of the chamber is several times larger than the numerical aperture $NA_2$ of the divergent laser beam, which passed through the plasma, from the second side of the chamber. Plasma lens formation is accompanied by an increase in the fraction of laser radiation power that is absorbed by the plasma, which increases light source efficiency, leading to further increases in source brightness in the direction of radiation output onto the optical system for collecting plasma radiation.

When $NA_2$<<NA., simple and reliable non-selective blockers can be used in the small axial zone of beam 15, which simplifies the light source, providing high stability and long service life.

All this accounts for the undeniable merits of the proposed invention embodiment.

Formation of plasma lens and decrease of numerical aperture $NA_2$ of the divergent laser beam 9 that passed through the plasma, blocked from the second side I of chamber 1, can be accompanied by significant, by roughly a size factor, increase in power density of laser radiation on blocker 8. As such, invention embodiments have blocker 8 located at a distance from chamber 1, wherein the power density of the divergent laser beam 9 that passed through the plasma is lower than the threshold for damage of blocker 8 when implemented in the form of an optical coating or absorbent barrier.

It should be noted, that implementation of the blocker as selectively reflective of lasers, in particular, IR laser radiation, that allows the passage of plasma radiation in wide spectral range, in particular, the UV range, is not achieved. Therefore, in invention embodiments, blocker 8 is made to either completely reflective or completely absorbing laser beam 9. This ensures reliability and simplicity of blocker design.

Forming a region of radiating plasma 6, in accordance with the invention, with properties of a plasma lens provides a significant reduction in numerical aperture $NA_2$ of divergent laser beam 9 from the second side 11 of the chamber. As a result of this, invention embodiments have blocker 8 located in the small axial zone of the divergent laser beam with numerical aperture $NA_2$<<NA. This makes it possible to obtain plasma 15 radiation beam, directed towards the optical system for collecting plasma radiation, of high brightness with very small axial zone: $NA_2$<<NA, shaded by non-selective blocker. Thus, for example, in the light source, corresponding to embodiments 2 and 3 on Table 1, blocker can shade less than 5% of the plasma radiation beam cross-section.

Under light source operating conditions that are close to optimal, the size of the ratio $NA_2/NA_1$ is in the range of 0.5-0.25.

Thus, the conditions for high-efficiency light source operation in accordance with the present invention are attained by the following conditions:

Aspect ratio d/l of transverse and longitudinal dimensions of the region of radiating plasma are in the range from 0.1 to 0.5, having typical d/1 values in the range from 0.14 to 0.4.

Numerical aperture $NA_2$ of the divergent laser beam from the second side of the chamber that passed through the plasma is lower than the numerical aperture $NA_1$ of the focused laser beam from the first side of the chamber: $NA_2<NA_1$, —due to implementation of conditions for forming a plasma lens in the region of radiating plasma and refraction of laser radiation on the plasma lens.

Laser power greater than 50-70 W.

In invention embodiments, during operation of laser-pumped light source, the laser beam 9 that passed through the plasma is directed back toward the plasma region due to its reflection from blocker 8. In the invention embodiment, illustrated in FIG. 3, the optical system 14 for collecting plasma radiation contains an input lens 17, where blocker 8 is installed at a larger distance from the chamber 1 than lens 17 and made in the form of a plate 23 coating 8, selectively reflective of laser beam 9. This system of optical elements 23, 8, with corresponding adjustments, directs the divergent laser beam 9 that passed through the plasma back into the plasma 7. Wherein blocker 8 is made in the form of a system of optical elements (17, 8, 23), directing the laser beam 9 that passed through the plasma back towards the region of radiating plasma.

In another embodiment the blocker can be implemented as an optical element, partially directing the laser beam that passed through the plasma back to the region of radiating plasma. Such an optical element can be implemented in the form of an optical meniscus, installed between the chamber and the optical system for collecting plasma radiation. Wherein the side of the meniscus facing the chamber has a spherical or modified spherical surface with center in the region of radiating plasma, with a reflective coating, in particular, such that it selectively reflects laser radiation.

In these invention embodiments, the laser pumping power is increased, which increases the efficiency and brightness of the light source, expanding the range of high-efficiency operating conditions. The remaining light source operations are implemented similar to those detailed above.

Therefore, when implemented in accordance with the present invention, the laser-pumped light source acquires a set of new significant, positive qualities.

When forming the region of radiating plasma, extended along the axis of the focused laser beam, with small aspect ratio d/l ranging from 0.1 to 0.5, and plasma radiation brightness along the axis of the focused laser beam close to the maximum attainable for the given laser power, wherein the output of plasma radiation onto the optical system, located on the second side of the chamber, for collecting plasma radiation is carried out using divergent beams of plasma radiation, with the direction of the optical axis primarily coinciding with the direction of the axis of the focused laser beam, the following primary advantages are attained.

For the region of radiating plasma, mostly optically transparent to intrinsic radiation, the greatest brightness with small, from 0.1 to 0.5, aspect ratio d/l is achieved in the direction of the axis of the focused laser beam. By choosing the optimal numerical aperture NA for the focused laser beam for each chosen value of laser power, at which high-efficiency device operation is possible, plasma radiation brightness close to the maximum attainable specifically in the direction of the axis of the focused laser beam is provided. The maximum brightness for a laser-pumped light source attainable in this way is invariantly transferred to the optical system for collecting plasma radiation, realizing a collection of radiation in the axial direction. This determines the attainment of significantly greater brightness of a light source implemented in accordance with the present invention, compared to similar sources that use non-axial plasma radiation collection.

As a result of selecting the numerical aperture NA for the focused laser beam and forming a region of radiating plasma extended along the axis of the focused laser beam, the efficiency of laser radiation absorption in plasma increases, which increases plasma radiation brightness.

By arranging the optical system for collecting plasma radiation on the axis of the focused laser beam, in particular, coaxially with the laser beam, symmetrical distribution of plasma radiation brightness across the aperture of beam of plasma radiation is achieved, including as it propagates along the system for collecting plasma radiation.

Use of the optical system for collecting plasma radiation, containing an input lens, ensures simplicity and reliability of the system for collecting high-brightness plasma radiation, as well as simplicity of the light source design as a whole. Implementing the blocker in the form of a laser radiation-reflective coating on the input lens provides compactness and further simplification of light source design.

According to the experimental data, aspect ratio d/l of the dimensions of the region of radiating plasma in the range from 0.14 to 0.4 provides the most efficient device operation.

Selecting a numerical aperture value NA for the plasma radiation beam, satisfying the condition NA d/l, provides the highest efficiency for collection of high-brightness plasma radiation.

Selecting numerical aperture $NA_1$ of the focused laser beam and laser power such that the numerical aperture $NA_2$ of the laser beam from the second side of the chamber, which passed through the region of radiating plasma, is less than the numerical aperture $NA_1$ of the focused laser beam from the first side of the chamber: $NA_2<NA_1$, is one of the criteria for high-efficiency operation of high-brightness laser-pumped light source. Forming the plasma lens in the region of radiating plasma, which carries out laser radiation refraction: $NA_2<NA_1$, according to experimental data, corresponds to the optimal condition for light source operation. It is likely that the conditions for creating the laser radiation focusing effect also provide greater efficiency of absorption of plasma laser radiation, which increases light source efficiency.

Placing the blocker in the small axial zone of the divergent laser beam with numerical aperture $NA_2$: $NA_2<<NA_1$ allows the use of simple and reliable, in particular, non-selective blockers which either reflect radiation in the broadband spectral range or completely absorb it. This can simplify the light source, ensure its reliability, high stability, and long service life.

Forming the region of radiating plasma with the properties of a plasma lens provides for the significant reduction of numerical aperture $NA_2$ of the divergent laser beam from the second side of the chamber. This provides the ability to obtain a plasma radiation beam of high brightness, coupled with the optical system for collecting radiation, with very small axial zone $NA_2<<NA_1$, shaded by the non-selective blocker.

Implementing the blocker such that it directs the divergent laser beam that passed through the plasma back towards the region of radiating plasma increases laser pumping power, which increases light source efficiency and brightness, expands the range of high-efficiency operating conditions.

Enhancing the divergent plasma radiation beam using the plasma radiation beam reflected by the spherical mirror or modified spherical mirror, installed on the first side of the chamber, significantly, by ~70%, increases the efficiency of plasma radiation collections and efficiency of laser-pumped light source as a whole.

Thus, the proposed invention allows a significant increase in brightness of broadband laser-pumped light source; increase of laser radiation absorption by the region of radiating plasma and increase efficiency of laser-pumped light source as a whole by ensuring design simplicity and compactness, increasing service life and lowering operating costs; as well as effectively and reliably eliminate unwanted laser radiation from passing into the system for plasma radiation collection. All of this expands the functional applications of the device.

INDUSTRIAL APPLICABILITY

High-brightness light source, implemented in accordance with the present invention, can be used for various projection systems, for inspecting, testing, or measuring properties of semiconductor wafers when manufacturing integrated circuits and photomasks or reticles related to their production, as well as in microscopy.

What is claimed is:

1. A laser-pumped light source, comprising a chamber (1), containing gas, a laser (2) providing a laser beam (3); an optical element (4), focusing the laser beam from a first side (5) of the chamber (1), a region of radiating plasma (6), created in the chamber (1) using a focused laser beam (7); a blocker, installed on an axis (10) of a divergent laser beam (9) from a second side (11) of the chamber, opposite the first side (5), and an optical system (14) for plasma radiation collection, wherein a numerical aperture $NA_1$ of the focused laser beam (7) and the laser (2) power selected such that, the region of radiating plasma (6) is extended along the axis (10) of the focused laser beam (7), having small, ranging from 0.1 to 0.5, aspect ratio d/l of transverse d and longitudinal l dimensions of the region of radiating plasma, brightness of plasma radiation in the direction along the axis (10) of the focused laser beam (7) is close to maximum attainable for a given laser (2) power, a numerical aperture $NA_2$ of the divergent laser beam (9) from the second side (11) of the chamber (1) is less than the numerical aperture $NA_1$ of the focused laser beam (7) from the first side (5) of the chamber: $NA_2<NA_1$, wherein the optical system (14) for collecting plasma radiation is positioned from the second side (11) of the chamber (1), and an output of plasma radiation onto the optical system (14) for collecting plasma radiation is carried out by a divergent beam (15) of plasma radiation with apex in the region of radiating plasma (6), characterized by a numerical aperture NA and an optical axis (16), direction of which primarily coincides with a direction of the axis (10) of the focused laser beam (7).

2. The device according to claim 1, wherein the numerical aperture NA of the divergent plasma radiation beam (15) close in magnitude or greater, than a value of aspect ratio d/l of dimensions of the region of radiating plasma (6): NA≈d/l (18), or NA>d/l (15).

3. The device according to claim 1, wherein the blocker (8) is located in a small axial zone of the divergent laser beam (9) with numerical aperture $NA_2$: $NA_2<<NA$.

4. The device according to claim 1, wherein the blocker (8) is made reflective, in particular, selectively reflecting the divergent laser beam (9) from the second side of the chamber (1).

5. The device according to claim 1, wherein the blocker (8) is made to absorb the divergent laser beam (9) from the second side of the chamber (1).

6. The device according to claim 1, wherein the blocker (8) is installed at a distance from the chamber (1) and radiation power density of the divergent laser beam (9) from the second side of the chamber (1) is less than a damage threshold of the blocker (8).

7. The device according to claim 1, wherein the optical system (14) for plasma radiation collection is located on the axis (10) of the focused laser beam (7).

8. The device according to claim 1, wherein the optical system (14) for plasma radiation collection contains input lens (17).

9. The device according to claim 1, wherein the optical system (14) for plasma radiation collection contains an input lens (17) and the blocker (8) is implemented as a reflective, in particular selectively reflective of the laser beam, coating on at least part of the input lens (17) surface.

10. The device according to claim 1, wherein the blocker (8) is included in system of optical elements (17, 23, 8) directing the laser beam (9) from the second side (11) of the chamber (1) back towards the region of radiating plasma (6).

11. The device according to claim 1, wherein the optical system (14) for plasma radiation collection contains an input lens (17) and the blocker (8) is installed at a greater distance from the chamber (1) than the input lens (17) and implemented as plate (23) coating (8), reflecting the divergent laser beam (9).

12. The device according to claim 1, wherein the blocker is implemented as an optical element, directing the divergent laser beam (9) that passed through plasma back into the region of radiating plasma (6).

13. The device according to claim 1, wherein the region of radiating plasma (6) has aspect ratio d/i of transverse and longitudinal dimensions in range of 0.14 to 0.4.

14. The device according to claim 1, wherein a concave spherical mirror (24) with center in the region of radiating plasma is located on the first side of the chamber, having an opening, in particular, optical opening, for input of the focused laser beam in the region of radiating plasma.

15. The device according to claim 1, wherein a concave modified spherical mirror (24) with center in the region of radiating plasma (6) is installed from the first side (5) of the chamber (1), with opening (25), in particular, optical opening, for input of the focused laser beam (7) in the region of radiating plasma (6).

16. A method for generating radiation, wherein plasma is ignited in a chamber (1) with gas and from a first side (5) of the chamber (1) a laser beam (7), in continuous mode, is focused into the chamber, a region of radiating plasma (6) is formed, extending along an axis of focused laser beam, with small, ranging from 0.1-0.5, aspect ratio d/l of transverse d and longitudinal I dimensions of the region of radiating plasma, wherein brightness of plasma radiation in a direction along the axis (10) of the focused laser beam (7) is close to a maximum attainable for a specified laser power, with properties of a plasma lens, providing a decrease in a numerical aperture $NA_2$ of a divergent laser beam (9) from a second side (11) of the chamber (1) compared to a numerical aperture $NA_1$ of the focused laser beam (7) from the first side of the chamber: $NA_2<NA_1$;

an output of plasma radiation onto an optical system (14), located on the second side (11) of the chamber, for collecting plasma radiation is carried out using a divergent beam (15) of plasma radiation, with a direction of an optical axis (16) primarily coinciding with the direction of the axis (10) of the focused laser beam, by using a blocker (8) prevent a passage of the divergent laser beam (9) to the optical system (14) for collecting plasma radiation.

17. The method for generating radiation according to claim 16, wherein the laser beam (9) that passed through the region of radiating plasma (6) is directed back to the region of radiating plasma due to its reflection from the blocker (8).

18. The method for generating radiation according to claim 16, wherein focused laser beam is inputted into the region of radiating plasma through an opening (25), in particular, the optical opening installed on the first side of a chamber concave spherical mirror (24) or a concave modified spherical mirror (24) with a center in the region of radiating plasma (6) and the divergent beam (15) of plasma radiation, directed onto the optical system (14) for plasma radiation collection, is enhanced by a plasma radiation beam (26), reflected from the concave spherical mirror (24) or the concave modified spherical mirror (24).

* * * * *